US011142008B2

(12) United States Patent
Tatsuta et al.

(10) Patent No.: US 11,142,008 B2
(45) Date of Patent: Oct. 12, 2021

(54) LIQUID EJECTING UNIT AND LIQUID EJECTING APPARATUS

(71) Applicant: SEIKO EPSON CORPORATION, Tokyo (JP)

(72) Inventors: Daiki Tatsuta, Matsumoto (JP); Masaaki Ando, Matsumoto (JP); Junya Suzuki, Shiojiri (JP); Takao Yamamoto, Matsumoto (JP); Ken Yamagishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/821,408

(22) Filed: Mar. 17, 2020

(65) Prior Publication Data

US 2020/0298598 A1 Sep. 24, 2020

(30) Foreign Application Priority Data

Mar. 20, 2019 (JP) ..... JP2019-052354

(51) Int. Cl.
*B41J 25/34* (2006.01)
*B41J 2/175* (2006.01)

(52) U.S. Cl.
CPC ..... *B41J 25/34* (2013.01); *B41J 2/1752* (2013.01); *B41J 2202/14* (2013.01); *B41J 2202/19* (2013.01)

(58) Field of Classification Search
CPC .... B41J 25/34; B41J 2202/14; B41J 2202/19; B41J 2/1752
See application file for complete search history.

(56) References Cited

U.S. PATENT DOCUMENTS 5,448,274 A 9/1995 Hirabayashi et al.
5,671,000 A * 9/1997 Hirabayashi ..... B41J 2/1752 347/50
2006/0139405 A1* 6/2006 Nellen ..... B41J 2/17503 347/49

FOREIGN PATENT DOCUMENTS

JP H05-162298 6/1993
JP H07-068777 3/1995
JP 2005-121198 5/2005
JP 2018-153944 10/2018

* cited by examiner

*Primary Examiner* — Henok D Legesse
(74) *Attorney, Agent, or Firm* — Workman Nydegger

(57) ABSTRACT

A liquid ejecting unit includes: a liquid ejecting head; and a coupling member coupled to the liquid ejecting head, in which the liquid ejecting head has a first-coupling portion and a second-coupling portion, the liquid ejecting unit further includes: a first-attachment portion provided in a first-position of the coupling member; a second-attachment portion provided in a second-position of the coupling member, the second position being different from the first position; a first-elastic body; and a second-elastic body, and the first-elastic body biases the first-attachment portion or the first-coupling portion in a state in which the first-attachment portion is in contact with the first-coupling portion and the second-elastic body biases the second-attachment portion or the second-coupling portion in a state in which the second-attachment portion is in contact with the second-coupling portion, so that the coupling member is coupled to the liquid ejecting head.

19 Claims, 11 Drawing Sheets

LIQUID EJECTING UNIT AND LIQUID EJECTING APPARATUS

The present application is based on, and claims priority from JP Application Serial Number 2019-052354, filed Mar. 20, 2019, the disclosure of which is hereby incorporated by reference herein in its entirety.

BACKGROUND

1. Technical Field

The present disclosure relates to a liquid ejecting unit and a liquid ejecting apparatus.

2. Related Art

A liquid ejecting apparatus that ejects a liquid such as an ink from a nozzle has been proposed in the related art. For example, JP-A-2018-153944 discloses a liquid ejecting apparatus including a head body that ejects an ink and a flow channel member having a flow channel that supplies the ink to the head body. The head body and the flow channel member are fixed to each other through a screw.

However, in a configuration of JP-A-2018-153944, since it is necessary to fasten a screw in a process of fixing the head body and the flow channel member, there is a problem that work efficiency is low.

SUMMARY

To solve the above problems, a liquid ejecting unit according to an exemplary aspect of the present disclosure includes: a liquid ejecting head that ejects a liquid; and a coupling member that is coupled to the liquid ejecting head, in which the liquid ejecting head has a first coupling portion and a second coupling portion, the liquid ejecting unit further includes: a first attachment portion that is installed in a first position of the coupling member; a second attachment portion that is installed in a second position that is different from the first position of the coupling member; a first elastic body that elastically biases the first attachment portion or the first coupling portion; and a second elastic body that elastically biases the second attachment portion or the second coupling portion, and the first elastic body biases the first attachment portion or the first coupling portion in a state in which the first attachment portion is in contact with the first coupling portion and the second elastic body biases the second attachment portion or the second coupling portion in a state in which the second attachment portion is in contact with the second coupling portion, so that the coupling member is coupled to the liquid ejecting head.

A liquid ejecting unit according to another aspect of the present disclosure includes: a liquid ejecting head that ejects a liquid; and a coupling member that is coupled to the liquid ejecting head, in which the liquid ejecting head has a coupling portion, the liquid ejecting unit further includes: an attachment portion installed in the coupling member; and an elastic body that elastically biases the attachment portion or the coupling portion, in a state in which the attachment portion is in contact with the coupling portion, the elastic body biases the attachment portion or the coupling portion, so that the coupling member is coupled to the liquid ejecting head, and the attachment portion is switched, through rotation, between a first state in which the attachment portion is not in contact with the coupling portion and a second state in which the attachment portion is in contact with the coupling portion.

A liquid ejecting unit according to yet another aspect of the present disclosure includes: a liquid ejecting head that ejects a liquid; and a coupling member that is coupled to the liquid ejecting head, in which the liquid ejecting head has a coupling portion, the liquid ejecting unit further includes: an attachment portion installed in the coupling member; and an elastic body that elastically biases the attachment portion or the coupling portion, in a state in which the attachment portion is in contact with the coupling portion, the elastic body biases the attachment portion or the coupling portion, so that the coupling member is coupled to the liquid ejecting head, and the coupling member is coupled to the liquid ejecting head by a restoring force of the elastic body, which is generated by shortening the elastic body to be shorter than a natural length.

DESCRIPTION OF EXEMPLARY EMBODIMENTS

A. First Embodiment

Figure 1:
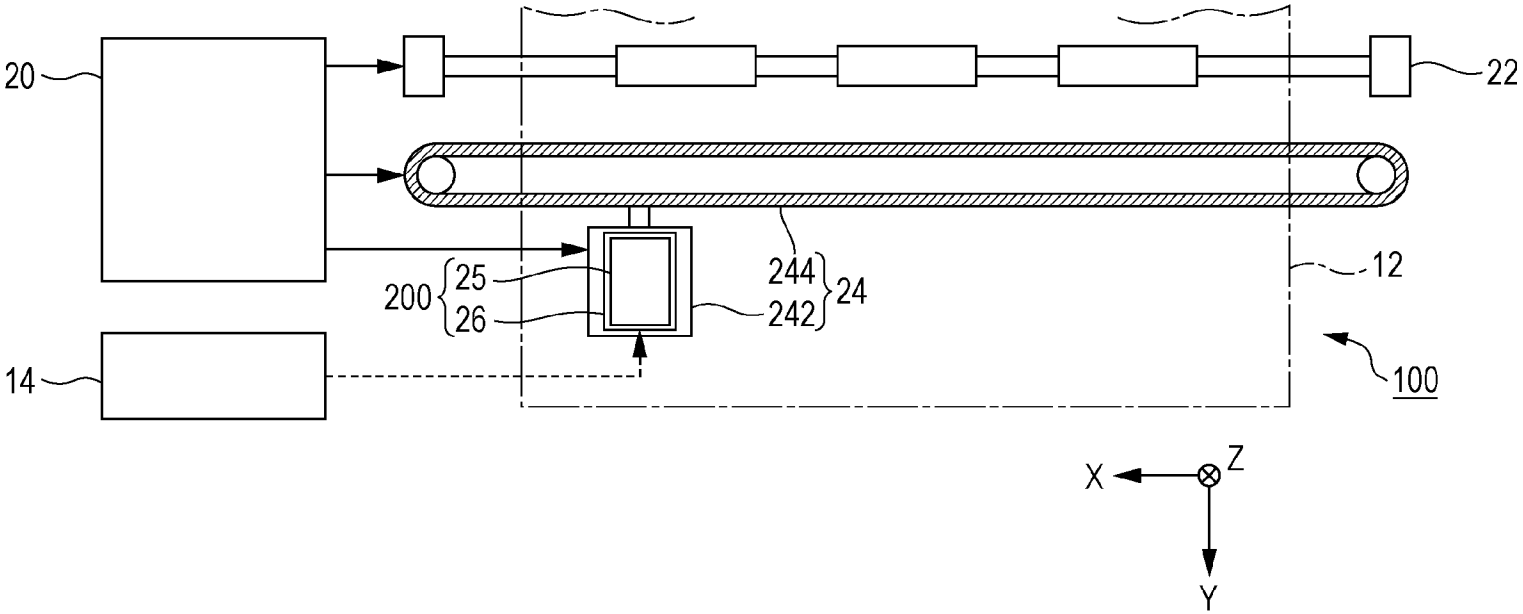
FIG. 1 is a diagram of a liquid ejecting apparatus according to a first embodiment.

FIG. 1 is a diagram illustrating a liquid ejecting apparatus 100 according to a first embodiment. The liquid ejecting apparatus 100 according to the first embodiment is an ink jet recording apparatus that ejects ink, which is an example of a liquid, onto a medium 12. Although the medium 12 is typically a recording paper sheet, a recording target made of a predetermined material such as a resin film and a fabric is used as the medium 12. As illustrated in FIG. 1, the liquid ejecting apparatus 100 is provided with a liquid container 14 that stores the ink. For example, a cartridge which can be attached to and detached from the liquid ejecting apparatus 100, a bag-like ink pack formed of a flexible film, or an ink tank which can be replenished with the ink is used as the liquid container 14.

As illustrated in FIG. 1, the liquid ejecting apparatus 100 includes a control unit 20, a transport mechanism 22, a movement mechanism 24, a flow channel member 25, and a liquid ejecting head 26. The control unit 20 includes a processing circuit such as a central processing unit (CPU) and a field programmable gate array (FPGA) and a storage circuit such as a semiconductor memory, and integrally controls each component of the liquid ejecting apparatus 100. The control unit 20 is an example of a controller. The transport mechanism 22 transports the medium 12 along a Y axis under a control of the control unit 20.

The movement mechanism 24 causes the flow channel member 25 and the liquid ejecting head 26 to reciprocate along the X axis under the control of the control unit 20. The X axis intersects the Y axis along which the medium 12 is transported. For example, the X axis and the Y axis are perpendicular to each other. The movement mechanism 24 according to the first embodiment includes a substantially box-shaped carriage 242 that stores the flow channel member 25 and the liquid ejecting head 26 and a transport belt 244 to which the carriage 242 is fixed. A configuration in which a plurality of the liquid ejecting heads 26 and the flow channel member 25 are mounted on the carriage 242 or a configuration in which the liquid container 14 is mounted on the carriage 242 together with the liquid ejecting head 26 and the flow channel member 25 may be employed.

The flow channel member 25 is a structure for supplying the ink from the liquid container 14 to the liquid ejecting head 26. The liquid ejecting head 26 ejects the ink supplied from the flow channel member 25. In detail, the liquid ejecting head 26 ejects the ink supplied from the liquid container 14 to the medium 12 from a plurality of nozzles under the control of the control unit 20. Each liquid ejecting head 26 ejects the ink to the medium 12 together with the transportation of the medium 12 by the transport mechanism 22 and the repeated reciprocation of the carriage 242, so that a desired image is formed on the surface of the medium 12. The flow channel member 25 and the liquid ejecting head 26 function as a liquid ejecting unit 200. In the following description, an axis that is perpendicular to the X-Y plane is thereinafter referred to as a Z axis. The Z axis is typically a vertical line.

Figure 2:
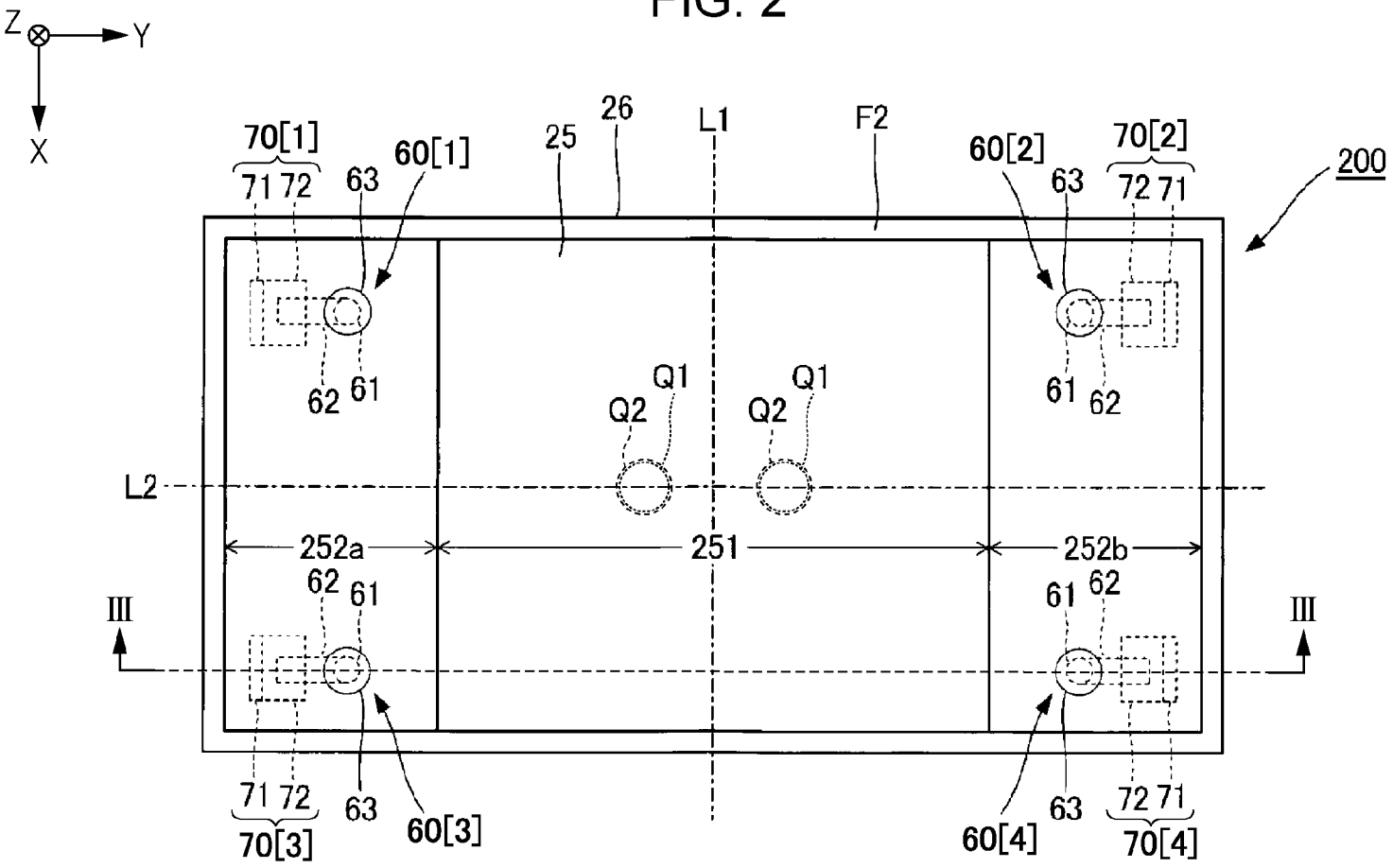
FIG. 2 is a plan view of a liquid ejecting unit.
Figure 3:
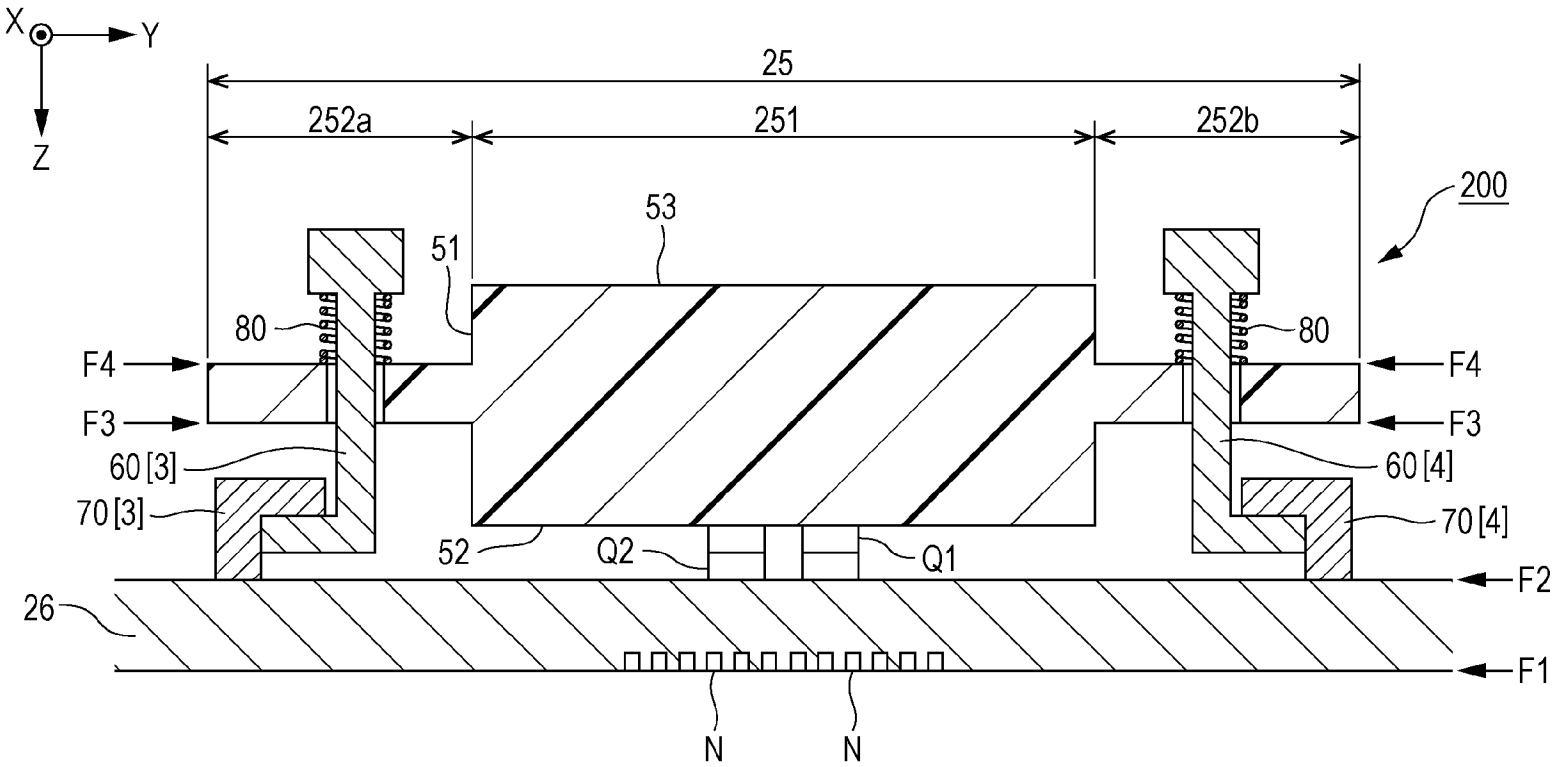
FIG. 3 is a sectional view taken along line III-III in FIG. 2.

FIG. 2 is a plan view of the liquid ejecting unit 200, and FIG. 3 is a sectional view taken along line III-III in FIG. 2. The liquid ejecting head 26 includes a nozzle surface F1 on which a plurality of nozzles N are formed and a mounting surface F2 that is opposite to the nozzle surface F1. The flow channel member 25 is installed on the mounting surface F2. As illustrated in FIG. 3, the flow channel member 25 is coupled to the liquid ejecting head 26. A first flow channel Q1 of the flow channel member 25 and a second flow channel Q2 of the liquid ejecting head 26 are coupled to each other. The ink supplied from the liquid container 14 to the flow channel member 25 is discharged from the first flow channel Q1, passes through the second flow channel Q2, and is ejected from the plurality of nozzles N of the liquid ejecting head 26.

As illustrated in FIGS. 2 and 3, the flow channel member 25 includes a flow channel forming portion 251, a first overhang portion 252*a*, and a second overhang portion 252*b*. The flow channel member 25 is integrally formed, for example, by injection molding of a resin material. The flow channel forming portion 251 is a portion of the flow channel member 25, in which a flow channel for supplying the ink to the liquid ejecting head 26 is formed. A lower surface 52 of the flow channel forming portion 251 faces the mounting surface F2 of the liquid ejecting head 26.

The first overhang portion 252*a* and the second overhang portion 252*b* are portions of the flow channel member 25, which project from side surfaces 51 of the flow channel forming portion 251. The first overhang portion 252*a* is formed on a side surface of the flow channel forming portion 251 along the Z axis in a negative direction of the Y axis, and the second overhang portion 252*b* is formed on a side surface of the flow channel forming portion 251 along the Z axis in a positive direction of the Y axis. That is, the first overhang portion 252*a* and the second overhang portion 252*b* are located on opposite sides with the flow channel forming portion 251 interposed therebetween in the Y axis direction. In the following description, when it is not necessary to particularly distinguish the first overhang portion 252*a* and the second overhang portion 252*b* from each other, the first overhang portion 252*a* and the second overhang portion 252*b* are simply referred to as an "overhang portion 252".

As illustrated in FIG. 3, the overhang portion 252 includes a lower surface F3 facing the mounting surface F2 of the liquid ejecting head 26 and an upper surface F4 opposite to the lower surface F3. As illustrated in FIG. 2, the width of the overhang portion 252 in the X axis direction coincides with the width of the flow channel forming portion 251 in the X axis direction. However, the width of the overhang portion 252 in the X axis direction may be smaller or larger than the width of the flow channel forming portion 251 in the X-axis direction. Further, the width of the overhang portion 252 in the Y axis direction is smaller than the width of the flow channel forming portion 251 in the Y axis direction. However, the width of the overhang portion 252 in the Y axis direction is predetermined. As illustrated in FIG. 3, the overhang portion 252 is installed at a substantially central portion of the side surface 51 of the flow channel forming portion 251 in the Z axis direction. However, the position where the overhang portion 252 is installed on the side surface 51 in the Z axis direction is predetermined. For example, a configuration in which the upper surface F4 of the overhang portion 252 is continuously formed on the upper surface 53 of the flow channel forming portion 251 or a configuration in which the lower surface F3 of the overhang portion 252 is continuously formed on the lower surface 52 of the flow channel forming portion 251 may be also employed.

As illustrated in FIG. 2, the liquid ejecting unit 200 includes four attachment portions 60[1] to 60[4]. The liquid ejecting head 26 includes four coupling portions 70[1] to 70[4]. Each attachment portion 60[*m*] and each coupling portion 70[*m*] are used to couple the flow channel member 25 to the liquid ejecting head 26 (m=1 to 4). The attachment portion 60[*m*] and the coupling portion 70[*m*] are installed to correspond to each other. That is, the liquid ejecting unit 200 includes a combination of the attachment portion 60[*m*] and the coupling portion 70[*m*].

As illustrated in FIG. 3, the attachment portion 60[*m*] is installed in the flow channel member 25. The attachment portion 60[*m*] is installed in the overhang portion 252 of the flow channel member 25. As illustrated in FIG. 2, the attachment portion 60[1] and the attachment portion 60[3] are installed in the first overhang portion 252*a*, and the attachment portion 60[2] and the attachment portion 60[4] are installed in the second overhang portion 252*b*. The attachment portion 60[*m*] is installed in an area of the overhang portion 252 in a positive direction of the X axis and an area of the overhang portion 252 in a negative direction of the X axis. The attachment portion 60[1] and the attachment portion 60[2] are located in the area in the negative direction of the X axis, and the attachment portion 60[3] and the attachment portion 60[4] are located in the area in the positive direction of the X axis.

The attachment portion 60[1] and the attachment portion 60[2] are located on opposite sides with a central line L1 of the flow channel member 25 interposed therebetween. One of the positions of the attachment portion 60[1] and the attachment portion 60[2] is an example of a "first position", and the other one thereof is an example of a "second position". Similarly, the attachment portion 60[3] and the attachment portion 60[4] are located on opposite sides with the central line L1 of the flow channel member 25 interposed therebetween. One of the positions of the attachment portion 60[3] and the attachment portion 60[4] is an example of a "first position", and the other one thereof is an example of a "second position". The central line L1 is a straight line that passes through the center of the flow channel member 25 and is parallel to the X axis in the X-Y plane. Further, the attachment portion 60[1] and the attachment portion 60[3] are located on opposite sides with a central line L2 of the flow channel member 25 interposed therebetween. The central line L2 is a straight line that passes through the center of the flow channel member 25 and is parallel to the Y axis in the X-Y plane. One of the positions of the attachment portion 60[1] and the attachment portion 60[3] is an example of a "first position", and the other one thereof is an example of a "second position". Similarly, the attachment portion 60[2] and the attachment portion 60[4] are located on opposite sides with the central line L2 of the flow channel member 25 interposed therebetween. One of the positions of the attachment portion 60[2] and the attachment portion 60[4] is an example of a "first position", and the other one thereof is an example of a "second position".

Figure 4:
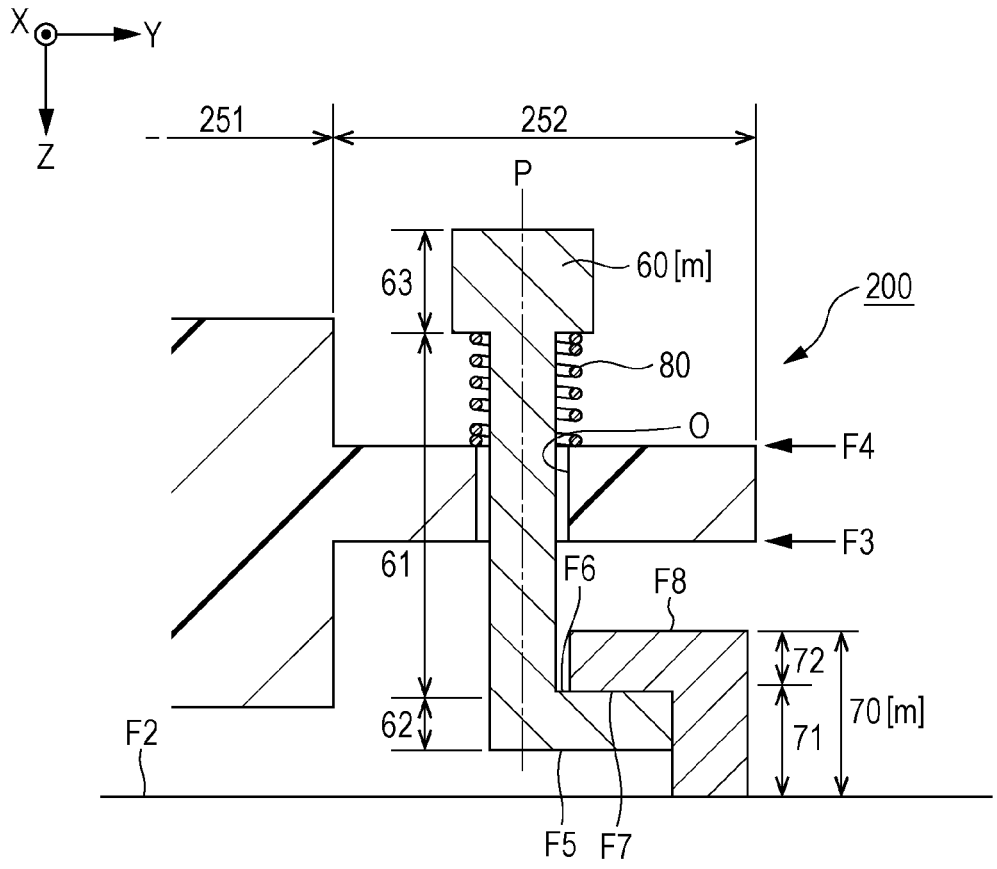
FIG. 4 is a sectional view of an attachment portion and a coupling portion.
Figure 5:
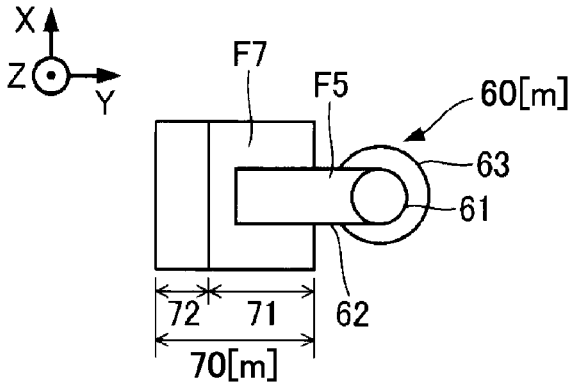
FIG. 5 is a plan view of an attachment portion and a coupling portion.

FIG. 4 is an enlarged sectional view of the attachment portion 60[*m*] and the coupling portion 70[*m*] in FIG. 3, and FIG. 5 is an enlarged plan view of the attachment portion 60[*m*] and the coupling portion 70[*m*] in FIG. 2. FIG. 5 is a plan view of the liquid ejecting head 26 when viewed from the mounting surface F2 side. That is, FIG. 5 is a plan view when viewed from a positive direction of the Z axis. As illustrated in FIG. 4, the attachment portion 60 includes a base portion 61, a support portion 62, and a catch 63. The base portion 61, the support portion 62, and the catch 63 may be formed integrally or may be joined to each other after being formed individually.

The base portion 61 is installed in the flow channel member 25. For example, a cylindrical member along the Z axis is used as the base portion 61. The base portion 61 according to the first embodiment passes through a through-hole O formed in the overhang portion 252. The catch 63 and the support portion 62 are located on opposite sides of the base portion 61. In the first embodiment, the support portion 62 is installed at an end portion of the base portion 61 on the liquid ejecting head 26 side, and the catch 63 is installed at the other end portion thereof. The support portion 62 is located between the liquid ejecting head 26 and the overhang portion 252. The position where the support portion 62 and the catch 63 are installed is not limited to the end portion of the support portion 62.

As illustrated in FIG. 5, the support portion 62 according to the first embodiment is a long member in a plan view from the Z axis direction. One end of the support portion 62 is coupled to the end portion of the base portion 61. That is, a member having an L-shaped cross-section is formed by the base portion 61 and the support portion 62. The catch 63 according the first embodiment is a cylindrical member. As illustrated in FIG. 5, the cross-sectional area of the catch 63 is larger than the cross-sectional area of the base portion 61 in the X-Y plane. For example, the central axes of the catch 63 and the base portion 61 coincide with each other. That is, the peripheral edge of the base portion 61 is located inside the peripheral edge of the catch 63 in a plan view from the Z axis direction. The support portion 62 includes a lower surface F5 facing the liquid ejecting head 26 and an upper surface F6 opposite to the lower surface F5.

As illustrated in FIG. 4, the liquid ejecting unit 200 includes an elastic body 80. The elastic body 80 is installed in each attachment portion 60[*m*]. That is, the liquid ejecting unit 200 includes the same number of elastic bodies 80 as the number of the attachment portions 60[*m*]. For example, a coil spring obtained by spirally winding a metal wire is used as the elastic body 80. The elastic body 80 is installed to surround the base portion 61. That is, the support portion 62 is located inside the elastic body 80. The elastic body 80 is located between the catch 63 and the overhang portion 252. One end of the elastic body 80 abuts on the lower surface of the catch 63, and the other end thereof abuts on the upper surface F4 of the overhang portion 252. The elastic body 80 elastically biases the attachment portion 60[*m*]. The elastic body 80 according to the first embodiment biases the attachment portion 60[*m*] in the negative direction of the Z axis. Hereinafter, the negative direction of the Z axis is referred to as a "biasing direction".

As illustrated in FIG. 3, each coupling portion 70[*m*] is formed on the mounting surface F2 of the liquid ejecting head 26. As illustrated in FIG. 4, the coupling portion 70[*m*] is formed by a first portion 71 and a second portion 72. The first portion 71 is a portion of the coupling portion 70[*m*], which protrudes vertically from the mounting surface F2. The second portion 72 is a portion of the coupling portion 70[*m*], which projects from the side surface of the first portion 71. The second portion 72 of the first embodiment projects from the first portion 71 in the Y axis direction. The second portion 72 projects from the first portion 71 toward the base portion 61.

The second portion 72 includes a lower surface F7 and an upper surface F8 opposite to the lower surface F7. An example of a "coupling surface" of the coupling portion 70[*m*], which contacts the attachment portion 60[*m*], is the lower surface F7. The upper surface F8 is a surface on the flow channel member 25 side. The upper surface F8 of the second portion 72 is closer to the liquid ejecting head 26 than the lower surface F3 of the overhang portion 252. That is, the upper surface F8 of the second portion 72 and the lower surface F3 of the overhang portion 252 face each other with a space therebetween. As illustrated in FIG. 4, the second portion 72 and the support portion 62 are in contact with each other. In detail, the lower surface F7 of the second portion 72 and the upper surface F6 of the support portion 62 face each other in a contact state. As illustrated in FIG. 5, the widths of the first portion 71 and the second portion 72 in the X axis direction are larger than the width of the support portion 62 in the X axis direction, in a plan view from the Z axis direction.

In a state in which the support portion 62 is in contact with the lower surface F7 of the second portion 72, the elastic body 80 biases the attachment portion 60[*m*] in a biasing direction. In other words, the biasing direction is a direction facing an opposite side of the support portion 62 with respect to the lower surface F7 of the second portion 72. As the second portion 72 is pressed by the support portion 62 in the biasing direction, the support portion 62 and the second portion 72 engage with each other. As a result, the flow channel member 25 is coupled to the liquid ejecting head 26. As understood from the above description, as the elastic body 80 biases the attachment portion 60[*m*] in a state in which the attachment portion 60[*m*] is in contact with the coupling portion 70[*m*], the flow channel member 25 is coupled to the liquid ejecting head 26.

Figure 6:
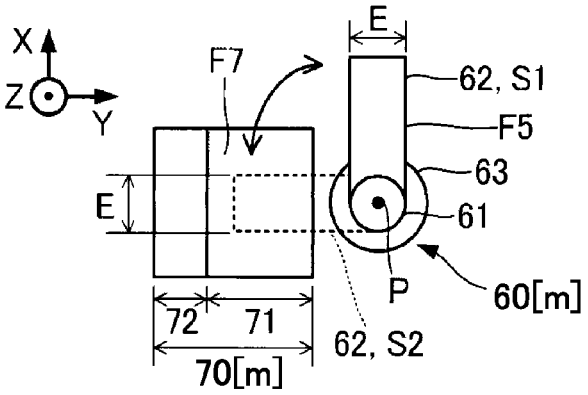
FIG. 6 is a plan view of a support portion that moves in accordance with rotation of the attachment portion.

Hereinafter, a procedure of coupling the flow channel member 25 to the liquid ejecting head 26 will be described. As illustrated in FIG. 4, the attachment portion 60[*m*] can rotate about a central axis P of the base portion 61. The support portion 62 rotates in a state in which the base portion 61 is inserted into the through-hole O of the overhang portion 252. FIG. 6 is a plan view of the support portion 62 that moves in accordance with rotation of the attachment portion 60[*m*]. The attachment portion 60[*m*]rotates about the central axis P to be switched between a first state S1 and a second state S2. As illustrated in FIG. 6, the first state S1 is a state in which the support portion 62 is not in contact with the lower surface F7 of the second portion 72. That is, the first state S1 is an initial state in which the flow channel member 25 and the liquid ejecting head 26 are not coupled to each other. In other words, the first state S1 is a state in which the support portion 62 does not overlap the second portion 72 in a plan view from the Z axis direction. In FIG. 6, a case where a tip E of the support portion 62 does not overlap the second portion 72 as a whole is described as an example of the first state S1. In the first state S1 of the first embodiment, the attachment portion 60[*m*] is located inside the peripheral edge of the flow channel member 25 in a plan view from the Z axis direction. That is, the attachment portion 60[*m*] in the first state S1 is provided at a position overlapping the flow channel member 25 in the X-Y plane.

On the other hand, the second state S2 is a state in which the support portion 62 is in contact with the lower surface F7 of the second portion 72 as illustrated by a broken line in FIG. 6. That is, the second state S2 is a state in which the flow channel member 25 and the liquid ejecting head 26 are coupled to each other. In other words, the second state S2 is a state in which the support portion 62 overlaps the second portion 72 in a plan view from the Z axis direction. That is, in the second state S2, the support portion 62 and the second portion 72 overlap each other in the X axis direction and the Y axis direction. In FIG. 6, a case where the tip E of the support portion 62 overlaps the second portion 72 as a whole is described as an example of the second state S2.

The attachment portion 60[*m*] biased by the elastic body 80 can rotate while being pressed in a direction that is opposite to the biasing direction. A positive direction of the Z axis is the direction that is opposite to the biasing direction. In a state in which the attachment portion 60[*m*] is pressed in the direction that is opposite to the biasing direction, the elastic body 80 is shorter than the natural length thereof. When the flow channel member 25 and the liquid ejecting head 26 are coupled to each other, in the first state S1, in a state in which the attachment portion 60[*m*] is pressed in the direction that is opposite to the biasing direction, the attachment portion 60[*m*] is rotated in a direction in which the support portion 62 approaches the coupling portion 70[*m*]. Then, after the attachment portion 60[*m*] is rotated to a position where the support portion 62 overlaps the second portion 72 of the coupling portion 70[*m*] in a plan view, the pressing of the attachment portion 60[*m*] is released. In the second state S2, the elastic body 80 is shorter than the natural length thereof. Accordingly, the attachment portion 60[*m*] is biased in the biasing direction by the elastic body 80, and the upper surface F6 of the support portion 62 comes into contact with the lower surface F7 of the second portion 72. That is, the attachment portion 60[*m*] is in the second state S2. As understood from the above description, the flow channel member 25 is coupled to the liquid ejecting head 26 by a restoring force of the elastic body 80, which is generated by making the elastic body 80 to be shorter than the natural length thereof.

On the other hand, when the coupling between the flow channel member 25 and the liquid ejecting head 26 is released, in the second state S2, the attachment portion 60[*m*] is pressed in the direction that is opposite to the biasing direction, so that the support portion 62 is separated from the second portion 72. Then, the support portion 62 is rotated in a direction in which the support portion 62 is separated from the coupling portion 70[*m*]. In detail, the attachment portion 60[*m*] is rotated to a position where the support portion 62 does not overlap the second portion 72 of the coupling portion 70[*m*] in a plan view. That is, the attachment portion 60[*m*] is in the first state S1.

For example, in a configuration in which the liquid ejecting head 26 and the flow channel member 25 are coupled to each other through a screw (hereinafter, referred to as a "comparative example"), it is necessary to fasten the screw in a process of coupling the liquid ejecting head 26 and the flow channel member 25, and thus work efficiency is low. On the other hand, in the first embodiment, as the elastic body 80 biases the attachment portion 60[*m*], the flow channel member 25 is coupled to the liquid ejecting head 26. Thus, as compared to the comparative example, the liquid ejecting head 26 and the flow channel member 25 can be efficiently coupled to each other.

In the comparative example, a space for fastening the screw is required in each of the liquid ejecting head 26 and the flow channel member 25. For example, a space is required for using a fastening tool around the screw. On the other hand, in the configuration of the first embodiment, a space for fastening the screw is not required, so that the liquid ejecting head 26 and the flow channel member 25 can be downsized.

Further, in the comparative example, since it is necessary to manage a torque when the screw is fastened, the process of coupling the liquid ejecting head 26 and the flow channel member 25 is complex. On the other hand, in the first embodiment, since the flow channel member 25 is coupled to the liquid ejecting head 26 by the elastic body 80 that biases the attachment portion 60[*m*], a troublesome operation such as the management of the torque is not required. Therefore, there is an advantage in that the process of coupling the flow channel member 25 and the liquid ejecting head 26 becomes easy.

In the first embodiment, since the flow channel member 25 is coupled to the liquid ejecting head 26 by the four attachment portions 60[1] to 60[4], the flow channel member 25 and the liquid ejecting head 26 are firmly fixed to each other, as compared to a configuration in which the flow channel member 25 and the liquid ejecting head 26 are coupled to each other by the one attachment portion 60[*m*]. However, the number of the attachment portion 60[*m*] is predetermined. For example, the flow channel member 25 and the liquid ejecting head 26 may be coupled to each other by the one attachment portion 60.

According to the configuration of the first embodiment in which the elastic body 80 is disposed on an opposite side to the support portion 62 with respect to the flow channel member 25 and the elastic body 80 biases the attachment portion 60[*m*] in the biasing direction, the liquid ejecting head 26 and the flow channel member 25 can be coupled to each other with a simple configuration. Further, since the elastic body 80 is located between the catch 63 and the flow channel member 25, the catch 63 can be used to support the elastic body 80. In the first embodiment, as the attachment portion 60[*m*] rotates about the central axis P of the base portion 61, the liquid ejecting head 26 and the flow channel member 25 can be coupled to each other, so that the liquid ejecting head 26 and the flow channel member 25 can be coupled to each other with a simple process of rotating the base portion 61. As the attachment portion 60[*m*] rotates in the X-Y plane, the attachment portion 60[*m*] comes into contact with the coupling portion 70[*m*]. However, the method of bringing the attachment portion 60 and the coupling portion 70[*m*] into contact with each other is not limited to the rotation of the attachment portion 60[*m*] in the X-Y plane. For example, a configuration in which the attachment portion 60[*m*] rotates in the Y-Z plane is also employed.

In the first embodiment, in the first state S1, the attachment portion 60[*m*] is located inside the peripheral edge of the flow channel member 25. Therefore, in a state in which the liquid ejecting head 26 and the flow channel member 25 are not coupled to each other, a workspace can be reduced in a process of the liquid ejecting head 26 and the flow channel member 25, as compared to a configuration in which the attachment portion 60[*m*] is located outside the peripheral edge of the flow channel member 25. However, in the first state S1, the configuration in which the attachment portion 60[*m*] is located outside the peripheral edge of the flow channel member 25 is also employed.

According to a configuration of the first embodiment in which two attachment portions 60[*m*] are located on opposite sides with the central lines L1 and L2 of the flow channel member 25 interposed therebetween, for example, the flow channel member 25 can be pressed evenly against the liquid ejecting head 26, as compared to a configuration in which the two attachment portions 60[*m*] are located on one side with the central line of the flow channel member 25 interposed therebetween.

Attention is paid to the predetermined two attachment portion 60[*m*1] and attachment portion 60[*m*2] among the four attachment portions 60[1] to 60[4] provided in the liquid ejecting unit 200 (m1≠m2). The attachment portion 60[*m*1] is an example of a "first attachment portion", and the attachment portion 60[*m*2] is an example of a "second attachment portion". The elastic body 80 that biases the attachment portion 60[*m*1] is an example of a "first elastic body", and the elastic body 80 that biases the attachment portion 60[*m*2] is an example of a "second elastic body". Further, the coupling portion 70[*m*1] that is in contact with the attachment portion 60[*m*1] is an example of a "first coupling portion", and the coupling portion 70[*m*2] that is in contact with the attachment portion 60[*m*1] is an example of a "second coupling portion".

B. Second Embodiment

A second embodiment will be described below. In the following examples, an element having the same function as that of the first embodiment is designated by the same reference numeral used in the description of the first embodiment, and detailed description thereof will be omitted as appropriate.

Figure 7:
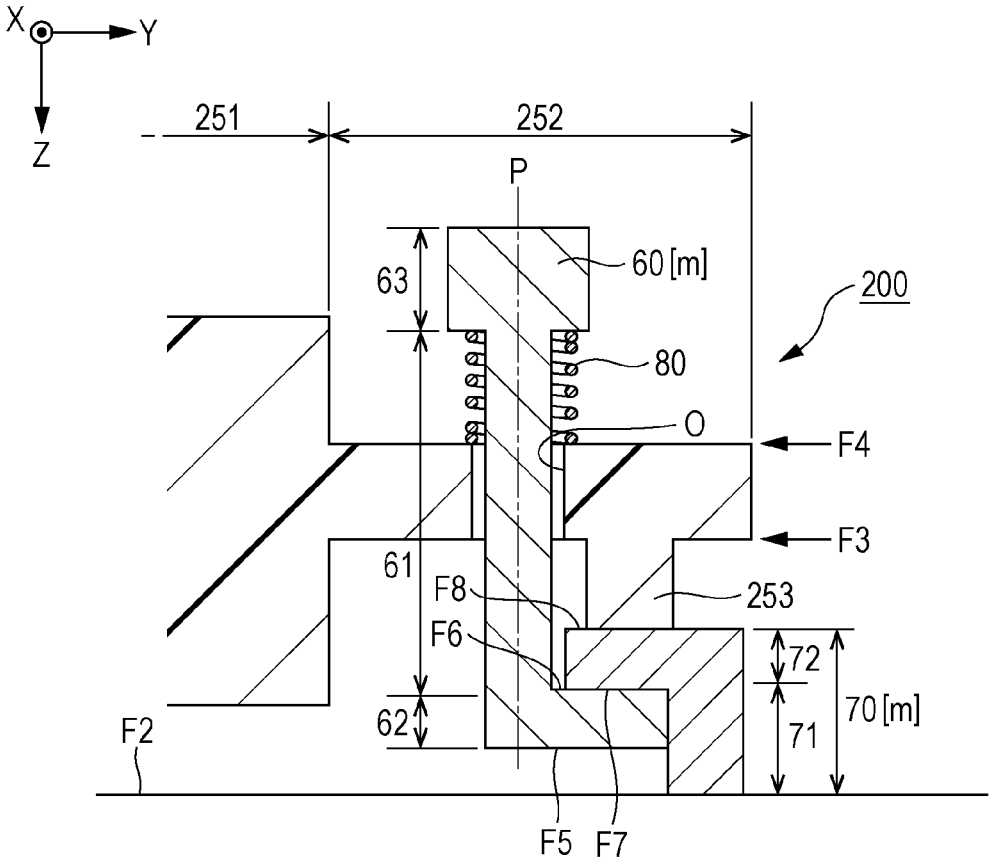
FIG. 7 is a sectional view of an attachment portion and a coupling portion according to a second embodiment.
Figure 8:
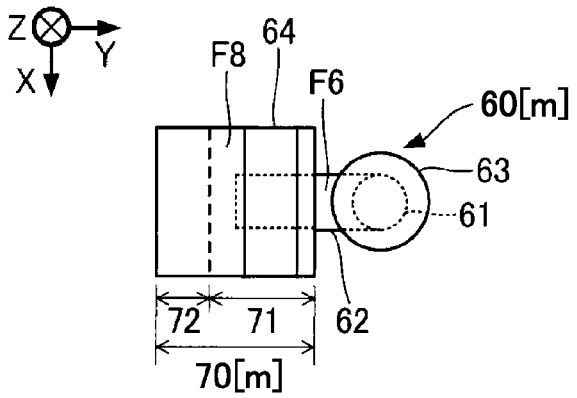
FIG. 8 is a plan view of the attachment portion and the coupling portion.

FIG. 7 is a sectional view of the attachment portion 60[*m*] and the coupling portion 70[*m*] according to the second embodiment, and FIG. 8 is a plan view of the attachment portion 60[*m*] and the coupling portion 70[*m*] according to the second embodiment. FIG. 8 is a plan view when viewed from the overhang portion 252 side. FIGS. 7 and 8 illustrate a case where the attachment portion 60[*m*] is in the second state S2. The flow channel member 25 according to the second embodiment includes a protrusion portion 253 in addition to the flow channel forming portion 251 and the overhang portion 252 that are the same as those according to the first embodiment. The protrusion portion 253 may be formed integrally with the overhang portion 252 or may be formed separately from the overhang portion 252. As illustrated in FIG. 7, the protrusion portion 253 is formed in the overhang portion 252. In detail, the protrusion portion 253 protrudes from the lower surface F3 of the overhang portion 252 toward the liquid ejecting head 26. The protrusion portion 253 is formed to be in contact with the coupling portion 70[*m*]. In detail, the protrusion portion 253 is in contact with the upper surface F8 of the second portion 72. The protrusion portion 253 is located on an opposite side to the support portion 62 with respect to the second portion 72. FIGS. 7 and 8 illustrate a configuration in which the protrusion portion 253 is formed in a part of an area of the lower surface F3 of the overhang portion 252, which faces the upper surface F8 of the second portion 72. As illustrated in FIG. 8, the width of the protrusion portion 253 in the X axis direction is substantially the same as the width of the second portion 72 in the X axis direction. Further, the width of the protrusion portion 253 in the Y axis direction is smaller than the width of the second portion 72 in the Y axis direction. The protrusion portion 253 may be formed over the entire area of the lower surface F3 of the overhang portion 252, which faces the upper surface F8 of the second portion 72. Further, the protrusion portion 253 may be formed over a wider area of the lower surface F3 of the overhang portion 252 than the upper surface F8 with the upper surface F8 of the second portion 72 as the center.

In the second embodiment, the same effect as that of the first embodiment is realized. In the second embodiment, in particular, since the flow channel member 25 is in contact with the upper surface F8 if the second portion 72 of the coupling portion 70[*m*], the coupling portion 70[*m*] can be supported from both the upper surface F8 and the lower surface F7 of the second portion 72. That is, the second portion 72 is pinched between the support portion 62 and the protrusion portion 253. Therefore, as compared to a configuration in which only the lower surface F7 of the second portion 72 is in contact with the coupling portion 70[*m*], the liquid ejecting head 26 and the flow channel member 25 can be coupled to each other more firmly.

C. Third Embodiment

Figure 9:
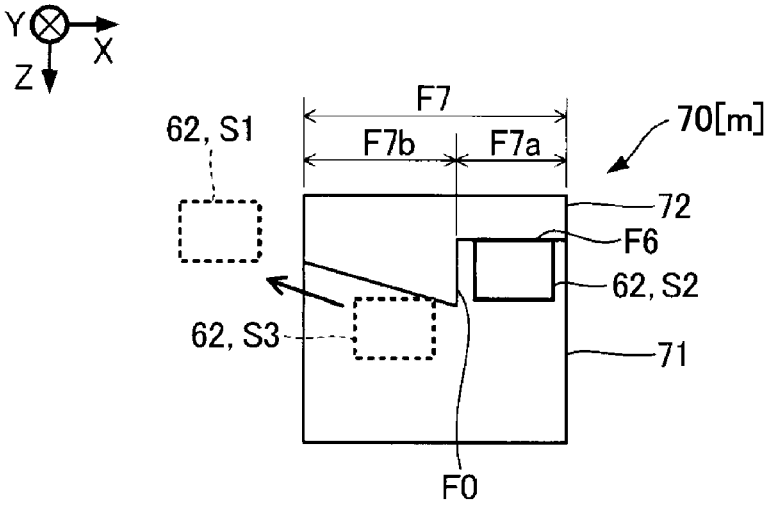
FIG. 9 is a side view of an attachment portion and a coupling portion according to a third embodiment.

FIG. 9 is a side view of a coupling portion 70[*m*] according to a third embodiment. FIG. 9 is a plan view when viewed from the flow channel forming portion 251 side. The shape of the coupling portion 70[*m*] according to the third embodiment is different from the shape of the coupling portion 70[*m*] according to the first embodiment. In detail, the shape of the lower surface F7 of the second portion 72 is different from that according to the first embodiment. As illustrated in FIG. 9, the lower surface F7 of the second portion 72 according to the third embodiment includes a first surface F7*a* and a second surface F7*b*. The first surface F7*a* is a surface that is parallel to the horizontal plane. On the other hand, the second surface F7*b* is an inclined surface that is inclined with respect to the first surface F7*a*. In detail, the second surface F7*b* is an inclined surface that is located in the biasing direction from a point separated from the first surface F7*a*. The first surface F7*a* is located in the biasing direction from the peripheral edge of the second surface F7*b* on the first surface F7*a* side. That is, in other words, the bottom surface of a recess portion recessed with respect to the second surface F7*b* is the first surface F7*a*. As illustrated in FIG. 9, a wall surface F0 is formed from the peripheral edge of the first surface F7*a* on the first surface F7*a* side toward the peripheral edge of the second surface F7*b* on the first surface F7*a* side.

As illustrated in FIG. 9, the attachment portion 60[*m*] according to the third embodiment is switched between the first state S1 and the second state S2, which is like the first embodiment. In the second state S2, the support portion 62 is in contact with the coupling portion 70[*m*], which is like the first embodiment. In detail, the upper surface F6 of the support portion 62 is in contact with the first surface F7*a* of the lower surface F7 of the second portion 72. That is, the first surface F7*a* is an example of a "coupling surface". The width of the support portion 62 in the X axis direction is smaller than the width of the first surface F7*a* in the X axis direction. In the second state S2 in which the support portion 62 is in contact with the first surface F7*a*, movement of the support portion 62 is restricted by the wall surface F0. That is, the coupling portion 70[*m*] firmly engages with the support portion 62. On the other hand, in the first state S1, the support portion 62 is not in contact with the second portion 72, which is like the first embodiment. In the first state S1 of the third embodiment, the support portion 62 is located in an area that does not overlap the second portion 72 on the second surface F7*b*.

When the flow channel member 25 and the liquid ejecting head 26 are coupled to each other, in a state in which the attachment portion 60[*m*] is pressed in a direction that is opposite to the biasing direction in the first state S1, the support portion 62 is rotated to a position overlapping the first surface F7*a* of the second portion 72. Then, the pressing of the attachment portion 60[*m*] is released and the upper surface F6 of the support portion 62 comes into contact with the first surface F7*a* of the second portion 72, so that the attachment portion 60[*m*] is in the second state S2. That is, the flow channel member 25 and the liquid ejecting head 26 are coupled to each other. Here, it is assumed that in the process of coupling the flow channel member 25 and the liquid ejecting head 26, the rotation of the attachment portion 60[*m*] is stopped before the support portion 62 reaches the first surface F7*a*. Under the above assumption, as illustrated in FIG. 9, the attachment portion 60[*m*] can be in a state S3 (hereinafter, referred to as a "third state) in which the support portion 62 is in contact with the second surface F7*b*. The third state S3 is a state between the first state S1 and the second state S2. A state in which the attachment portion 60[*m*] is located between the position of the attachment portion 60[*m*] in the first state S1 and the position of the attachment portion 60[*m*] in the second state S2 is the third state S3. In other words, a state in which the support portion 62 is in contact with the lower surface F7 of the second portion 72 and the liquid ejecting head 26 and the flow channel member 25 are not sufficiently coupled to each other is the third state S3.

When the attachment portion 60[*m*] is in the third state S3, the support portion 62 is rotated by the biasing of the elastic body 80, so that the attachment portion 60[*m*] approaches the first state S1. As described above, the attachment portion 60[*m*] is biased in the biasing direction by the elastic body 80. Therefore, when the attachment portion 60[*m*] is in the third state S3, the support portion 62 moves along the second surface F7*b* in a direction in which the support portion 62 is separated from the first surface F7*a*. That is, the attachment portion 60[*m*] is in the first state S1. In the third embodiment, as the support portion 62 moves to a position where the support portion 62 is not in contact with the lower surface F7 of the second portion 72, the attachment portion 60[*m*] is in the first state S1.

In the third embodiment, the same effect as that of the first embodiment is realized. In the third embodiment, in the third state S3, the attachment portion 60[*m*] approaches the first state S1 by the biasing of the elastic body 80. Therefore, in the third state S3 in which the attachment portion 60[*m*] does not reach the first state S1, a possibility that the liquid ejecting head 26 and the flow channel member 25 are not sufficiently coupled to each other can be reduced. In the third embodiment, in particular, since the support portion 62 moves along the second surface F7*b* by the biasing of the elastic body 80, the attachment portion 60[*m*] can approach the first state S1 from the third state S3 with a simple configuration.

According to a configuration of the third embodiment in which the first surface F7*a* is located in the biasing direction from the periphery edge of the second surface F7*b* on the second surface F7*b* side, as the attachment portion 60[*m*] moves from the first state S1 to the second state S2, the support portion 62 can firmly engage with the coupling portion 70[*m*].

D. Fourth Embodiment

Figure 10:
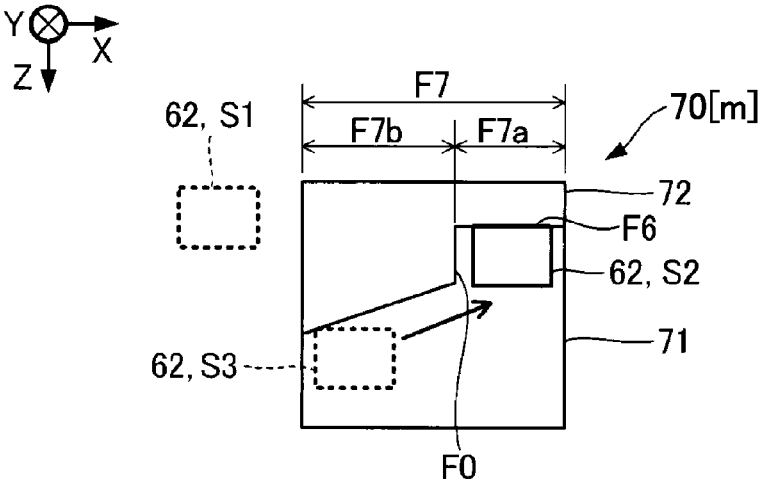
FIG. 10 is a side view of an attachment portion and a coupling portion according to a fourth embodiment.

FIG. 10 is a side view of a coupling portion 70[*m*] according to a fourth embodiment. FIG. 10 is a plan view when viewed from the flow channel forming portion 251. The lower surface F7 of the second portion 72 of the coupling portion 70[*m*] includes the first surface F7*a* and the second surface F7*b*, which is like the third embodiment. The first surface F7*a* is a surface that is parallel to the horizontal plane, which is like the third embodiment. The second surface F7*b* is an inclined surface that is inclined with respect to the first surface F7*a*, which is like the third embodiment. However, the second surface F7*b* according to the fourth embodiment is an inclined surface located in a direction that is opposite to the biasing direction from a point separated from the first surface F7*a*. The configuration other than the second surface F7*b* is the same as that according to the third embodiment.

In the third state S3 of the fourth embodiment, as the support portion 62 is rotated by the biasing of the elastic body 80, the attachment portion 60[*m*] approaches the second state S2. In detail, the support portion 62 is rotated by the biasing of the elastic body 80, so that the attachment portion 60[*m*] is in the second state S2. As described above, the attachment portion 60[*m*] is biased in the biasing direction by the elastic body 80. Therefore, when the attachment portion 60[*m*] is in the third state S3, the support portion 62 moves along the second surface F7*b* in a direction in which the support portion 62 approaches the first surface F7*a*. That is, the attachment portion 60[*m*] is in the second state S2. In the third embodiment, as the support portion 62 moves to a position where the support portion 62 is in contact with the first surface F7*a*, the attachment portion 60[*m*] is in the second state S2. Similar to the third embodiment, in the second state S2, the movement of the support portion 62 is restricted by the wall surface F0.

In the fourth embodiment, the same effect as that of the first embodiment is realized. In the fourth embodiment, in the third state S3, the attachment portion 60[*m*] approaches the second state S2 by the biasing of the elastic body 80. Therefore, even in the third state S3 in which the attachment portion 60[*m*] does not reach the second state S2, the attachment portion 60[*m*] approaches the second state S2, so that the liquid ejecting head 26 and the flow channel member 25 can be sufficiently coupled to each other.

In the third embodiment and the fourth embodiment, the configuration in which the first surface F7*a* is located in the biasing direction from the peripheral edge of the second surface F7*b* on the first surface F7*a* side. However, in the biasing direction, the position of the peripheral edge of the second surface F7*b* on the first surface F7*a* side may be the same as the position of the first surface F7*a*. In the above configuration, the wall surface F0 is omitted.

E. Modification Example

Each embodiment illustrated above can be variously modified. Detailed modifications that can be applied to the above-described embodiments will be described as an example below. Two or more aspects selected from the following examples in a predetermined manner can be appropriately combined as long as the aspects do not contradict each other.

(1) In the above-described embodiments, the configuration in which the flow channel member 25 includes the flow channel forming portion 251 and the overhang portion 252 has been described as an example. However, the configuration of the flow channel member 25 is predetermined. For example, a configuration in which the overhang portion 252 is omitted from the flow channel member 25 or a configuration in which a member that is different from the flow channel forming portion 251 and the overhang portion 252 is included is also employed.

(2) In the above-described embodiments, the attachment portion 60[*m*] is installed in the overhang portion 252 of the flow channel member 25. However, the position where the attachment portion 60[*m*] is installed is not limited to the overhang portion 252. For example, the attachment portion 60[*m*] may be installed in the flow channel forming portion 251. Similarly, the position where the elastic body 80 is installed can be also changed as appropriate according to the attachment portion 60[*m*].

(3) In the above-described embodiments, the attachment portion 60[*m*] is configured by the catch 63, the support portion 62, and the base portion 61. However, the configuration of the attachment portion 60[*m*] is not limited to the above example. The shape of the attachment portion 60[*m*] is predetermined as long as the attachment portion 60[*m*] can be in contact with the coupling portion 70[*m*] by the biasing of the elastic body 80. For example, the attachment portion 60[*m*] may be configured by the catch 63 and the support portion 62 or the attachment portion 60[*m*] may include a portion that is different from the catch 63, the support portion 62, and the base portion 61. The shape of the attachment portion 60[*m*] can be changed in a predetermined manner. A predetermined portion of the attachment portion 60[*m*] is in contact with the coupling portion 70[*m*].

(4) In the above-described embodiments, the coupling portion 70[*m*] is configured by the first portion 71 and the second portion 72. However, the configuration of the coupling portion 70[*m*] is not limited to the above example. The shape of the coupling portion 70[*m*] is predetermined as long as the coupling portion 70[*m*] can be in contact with the attachment portion 60[*m*]. For example, a configuration in which the second portion 72 is omitted from the coupling portion 70[*m*] or a configuration in which the coupling portion 70[*m*] includes a portion that is different from the first portion 71 and the second portion 72 is also employed. The shape of the coupling portion 70[*m*] can be changed in a predetermined manner. A predetermined portion of the coupling portion 70[*m*] is in contact with the attachment portion 60[*m*].

Figure 11:
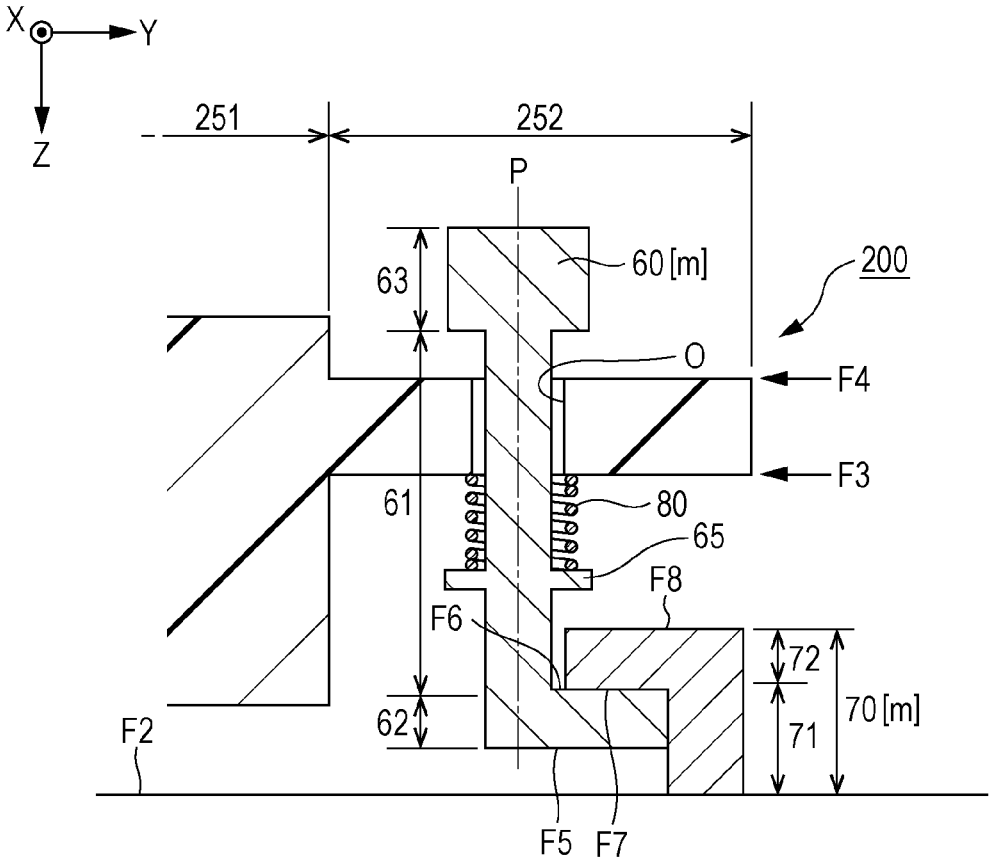
FIG. 11 is a sectional view of an attachment portion and a coupling portion according to a modification example.

(5) In the above-described embodiments, the elastic body 80 is installed on the upper surface F4 of the overhang portion 252. However, a place where the elastic body 80 is installed is predetermined. For example, as illustrated in FIG. 11, the elastic body 80 may be installed on the lower surface F3 of the overhang portion 252. In detail, a fixing portion 65 that projects from the outer peripheral surface of the base portion 61 is formed between the overhang portion 252 and the support portion 62 in the base portion 61. The elastic body 80 is supported on the upper surface of the fixing portion 65 and the lower surface F3 of the overhang portion 252. The elastic body 80 biases the attachment portion 60[*m*] in the biasing direction.

(6) In the above-described embodiments, the cylindrical catch 63 is used. However, the shape of the catch 63 is predetermined. For example, the catch 63 may have the same shape as that of the support portion 62. According to the configuration in which the catch 63 and the support portion 62 have the same shape, the position of the support portion 62 can be grasped according to the position of the catch 63 when the attachment portion 60[*m*] is rotated.

(7) In the above-described embodiments, the configuration has been employed in which the flow channel member 25 and the liquid ejecting head 26 are coupled to each other using a restoring force generated by shortening the elastic body 80 from the natural length state thereof. However, as illustrated in FIG. 11, a configuration is also employed in which the flow channel member 25 and the liquid ejecting head 26 are coupled to each other using a restoring force generated by lengthening the elastic body 80 from the natural length state thereof.

(8) In the above-described embodiments, in a sectional view from the X axis direction (that is, in the Y axis direction), the configuration has been employed in which the attachment portion 60[*m*] is installed at a position closer to the flow channel forming portion 251 than the coupling portion 70[*m*]. However, the positions of the coupling portion 70[*m*] and the attachment portion 60[*m*] may be reversed.

(9) In the above-described embodiments, both the lower surface 52 of the flow channel member 25 and the mounting surface F2 of the liquid ejecting head 26 are coupled to each other to face each other. However, a positional relationship between the flow channel member 25 and the liquid ejecting head 26 is not limited to the above configuration. For example, the liquid ejecting head 26 and the flow channel member 25 located on the same plane as the liquid ejecting head 26 may be coupled to each other using the attachment portion 60[*m*] and the coupling portion 70[*m*]. The shapes of the attachment portion 60[*m*] and the coupling portion 70[*m*] can be appropriately changed according to the positions of the flow channel member 25 and the liquid ejecting head 26.

(10) In the above-described embodiments, the configuration has been illustrated in which the flow channel member 25 and the liquid ejecting head 26 are coupled to each other. However, a member coupled to the liquid ejecting head 26 is not limited to the flow channel member 25. For example, when an electric wiring member having electric wiring is coupled to the liquid ejecting head 26, the configurations of the above-described embodiments may be applied. The member coupled to the liquid ejecting head 26 is comprehensively expressed as a "coupling member".

(11) In the above-described embodiments, as the support portion 62 of the attachment portion 60[*m*] penetrates the through-hole O formed in the overhang portion 252, the attachment portion 60[*m*] is installed in the flow channel member 25. However, the method of installing the attachment portion 60[*m*] in the flow channel member 25 is not limited to the above example. That is, it is not necessary to form the through-hole O in the overhang portion 252.

Figure 12:
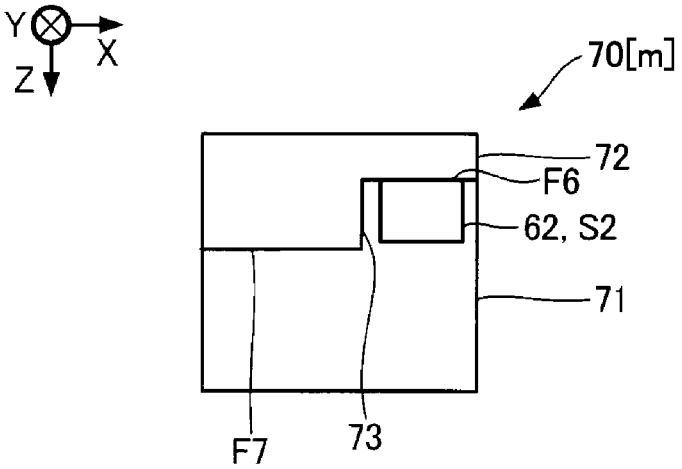
FIG. 12 is a side view of the attachment portion and the coupling portion according to the modification example.
Figure 13:
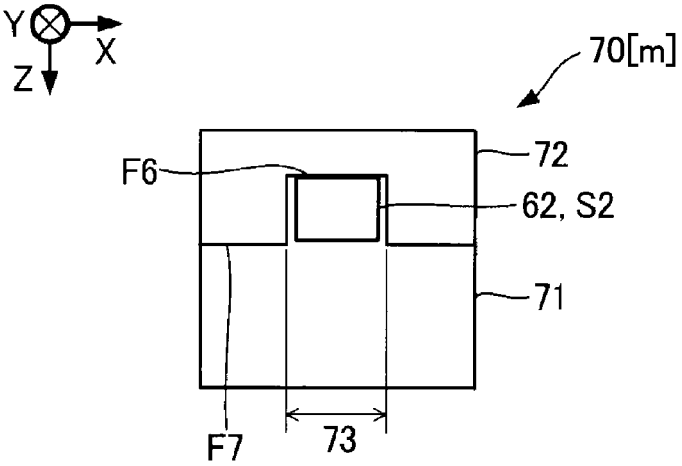
FIG. 13 is a side view of the attachment portion and the coupling portion according to the modification example.

(12) In the first embodiment and the second embodiment, for example, as illustrated in FIGS. 12 and 13, a recess portion that engages with the support portion 62 may be formed in the lower surface F7 of the second portion 72. In the above configuration, the bottom surface of the recess portion is an example of a "coupling surface".

(13) In the second embodiment, the protrusion portion 253 of the flow channel member 25 is in contact with the upper surface F8 of the second portion 72. However, for example, a configuration is also employed in which the lower surface F3 of the overhang portion 252 is in contact with the upper surface F8 of the second portion 72. In the above configuration, the protrusion portion 253 is omitted from the flow channel member 25.

Figure 14:
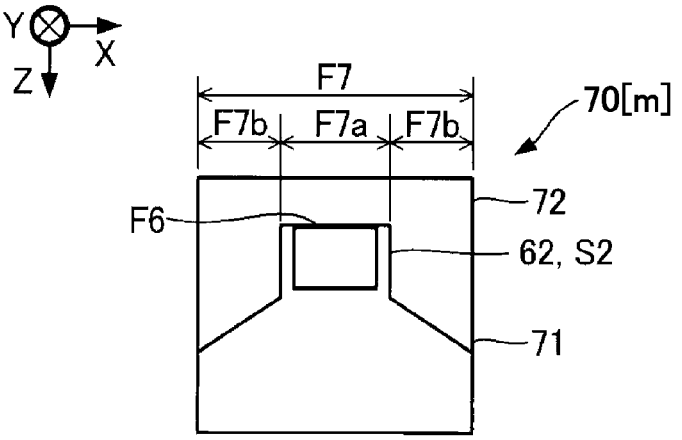
FIG. 14 is a plan view of the attachment portion and the coupling portion according to the modification example.

(14) In the third embodiment, as illustrated in FIG. 14, the second surfaces F7*b* may be formed on both sides with the first surface F7*a* interposed therebetween. Similarly, even in the fourth embodiment, the second surfaces F7*b* may be formed on both sides with the first surface F7*a* interposed therebetween.

(15) In the first embodiment, the state in which the tip of the support portion 62 overlaps the lower surface F7 of the second portion 72 as a whole is set as the second state S2. However, a state in which at least a part of the tip E of the support portion 62 overlaps the lower surface F7 of the second portion 72 may be set as the second state S2. Similarly, a state in which at least a part of the tip E of the support portion 62 does not overlap the lower surface F7 of the second portion 72 may be set as the first state S1.

Figure 15:
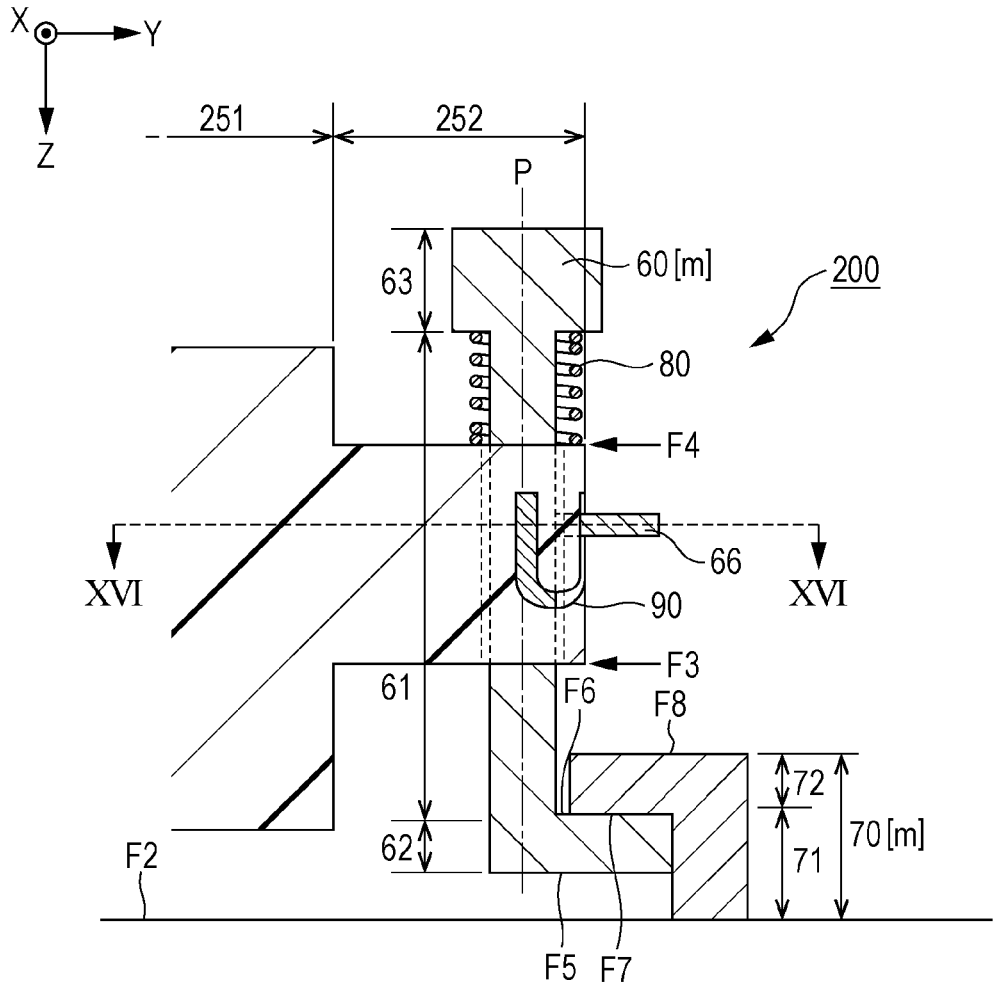
FIG. 15 is a sectional view of the attachment portion and the coupling portion according to the modification example.
Figure 16:
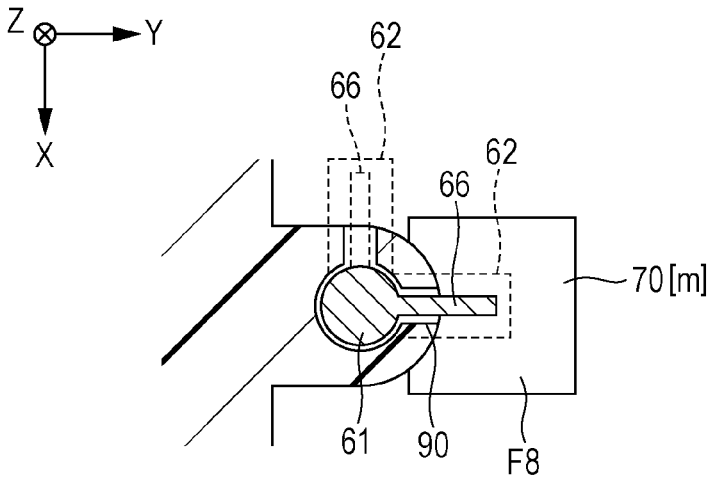
FIG. 16 is a sectional view of the attachment portion and the coupling portion according to the modification example.

(16) FIG. 15 is a plan view illustrating a configuration of the attachment portion 60[*m*] according to the modification example, and FIG. 16 is a sectional view taken along line XVI-XVI in FIG. 15. A protrusion portion 66 is formed between the catch 63 and the support portion 62 in the base portion 61 of the attachment portion 60[*m*]. The protrusion portion 66 is, for example, a cylindrical member, and is formed to protrude from the base portion 61 in the same direction as the support portion 62. A through-hole 90 is formed on the side surface of the overhang portion 252 such that the support portion 62 can move according to the rotation of the attachment portion 60[*m*]. It is preferable that the side surface of the overhang portion 252 is a curved surface. For example, the U-shaped through-hole 90 is formed in which lower ends of a pair of linear portions parallel to each other are coupled to each other by an arc-shaped portion. A state in which the protrusion portion 66 is located at one end of the through-hole 90 is set as the second state S2 in which the support portion 62 is in contact with the coupling portion 70[*m*]. On the other hand, a state in which the protrusion portion 66 is located at the other end of the through-hole 90 is set as the first state S1 in which the support portion 62 is not in contact with the coupling portion 70[*m*]. When the protrusion portion 66 is located between the one end and the other end of the through-hole 90, the protrusion portion 66 moves to one of the one end and the other end of the through-hole 90 along an inner wall of the through-hole 90. The shape of the through-hole 90 is not limited to the U shape.

(17) In the above-described embodiments, the configuration in which the elastic body 80 is provided in the attachment portion 60[*m*] has been illustrated. However, other aspects can be implemented. For example, a configuration is also employed in which the attachment portion 60[*m*] is provided integrally with the overhang portion 252 and the elastic body 80 is provided in the coupling portion 70[*m*]. In the above configuration, the coupling portion 70[*m*] can move in the Z axis direction, and when the coupling portion 70[*m*] moves to come into contact with the attachment portion 60[*m*], the elastic body 80 biases the coupling portion 70[*m*] in the positive direction of the Z axis, so that the liquid ejecting head 26 and the coupling member may be coupled to each other.

(18) In the above-described embodiments, a serial type liquid ejecting apparatus 100 is illustrated which causes the carriage 242, on which the liquid ejecting head 26 is mounted, to reciprocate. However, the present disclosure can be applied to a line-type liquid ejecting apparatus in which the plurality of nozzles N are distributed over the entire width of the medium 12.

(19) The liquid ejecting apparatus 100 illustrated in the above-described embodiments may be adopted for various apparatuses such as a facsimile apparatus and a copying machine in addition to equipment dedicated to printing. However, usage of the liquid ejecting apparatus of the present disclosure is not limited to printing. For example, the liquid ejecting apparatus that ejects a solution of a color material is used as a manufacturing apparatus that forms a color filter of a liquid crystal display device. Further, a liquid ejecting apparatus that ejects a solution of a conductive material is used as a manufacturing apparatus that forms a wiring and an electrode of a wiring board.

What is claimed is:

1. A liquid ejecting unit comprising:

a liquid ejecting head configured to eject a liquid; and a coupling member being coupled to the liquid ejecting head, wherein the liquid ejecting head has a first coupling portion and a second coupling portion, the liquid ejecting unit further comprises:

a first attachment portion provided in a first position of the coupling member;

a second attachment portion provided in a second position of the coupling member, the second position being different from the first position;

a first elastic body that elastically biases the first attachment portion or the first coupling portion; and a second elastic body that elastically biases the second attachment portion or the second coupling portion, and the first elastic body biases the first attachment portion or the first coupling portion in a state in which the first attachment portion is in contact with the first coupling portion and the second elastic body biases the second attachment portion or the second coupling portion in a state in which the second attachment portion is in contact with the second coupling portion, so that the coupling member is coupled to the liquid ejecting head, wherein the first attachment portion has a base portion provided in the coupling member, and a support portion that is provided in the base portion and that is in contact with the first coupling portion, the coupling member is located between the first elastic body and the support portion, the first coupling portion includes a coupling surface that faces away from the coupling member, and the first elastic body biases the first attachment portion or the first coupling portion in a biasing direction facing away from the support portion with respect to the coupling surface in a state in which the support portion is in contact with the coupling surface of the first coupling portion.

2. The liquid ejecting unit according to claim 1, wherein the first attachment portion has a catch that is provided on the base portion and that faces away from the support portion, the coupling member is located between the catch and the support member, and the first elastic body is located between the catch and the coupling member.

3. The liquid ejecting unit according to claim 1, wherein the first coupling portion includes a first surface that faces away from the coupling surface, and the coupling member is in contact with the first surface of the first coupling portion.

4. The liquid ejecting unit according to claim 1, wherein the first attachment portion rotates about a central axis of the base portion, and is thus switched between a first state in which the support portion is not in contact with the coupling surface and a second state in which the support portion is in contact with the coupling surface.

5. The liquid ejecting unit according to claim 4, wherein in the first state, the first attachment portion is located inside a peripheral edge of the coupling member in plan view.

6. The liquid ejecting unit according to claim 4, wherein in a third state between the first state and the second state, the support portion rotates by the biasing of the first elastic body, so that the first attachment portion approaches the first state.

7. The liquid ejecting unit according to claim 6, wherein the first coupling portion includes a second surface that faces away from the coupling member, the second surface of the coupling portion includes the coupling surface and an inclined surface, the inclined surface is inclined toward the biasing direction as separated from the coupling surface, and in the third state, the support portion is in contact with the inclined surface, and the support portion moves along the inclined surface by the biasing of the first elastic body.

8. The liquid ejecting unit according to claim 7, wherein the inclined surface includes a peripheral edge that is located on the coupling surface side, and the coupling surface is located in the biasing direction with respect to the peripheral edge of the inclined surface.

9. The liquid ejecting unit according to claim 4, wherein in a third state between the first state and the second state, the support portion rotates by the biasing of the first elastic body, so that the first attachment portion approaches the second state.

10. The liquid ejecting unit according to claim 1, wherein the first position and the second position are opposite to each other with a central line of the coupling member interposed therebetween.

11. The liquid ejecting unit according to claim 1, wherein the coupling member is a flow channel member having a flow channel for supplying the liquid to the liquid ejecting head.

12. A liquid ejecting apparatus comprising the liquid ejecting unit according to claim 1.

13. A liquid ejecting unit comprising:

a liquid ejecting head configured to eject a liquid; and a coupling member being coupled to the liquid ejecting head, wherein the liquid ejecting head has a coupling portion, the liquid ejecting unit further comprises:

an attachment portion provided in the coupling member; and an elastic body that elastically biases the attachment portion or the coupling portion, in a state in which the attachment portion is in contact with the coupling portion, the elastic body biases the attachment portion or the coupling portion, so that the coupling member is coupled to the liquid ejecting head, the attachment portion has a base portion provided in the coupling member, and a support portion that is provided in the base portion and that is in contact with the coupling portion, the attachment portion is switched, through rotation, between a first state in which the support portion is not in contact with the coupling portion and a second state in which the support portion is in contact with the coupling portion, and the attachment portion rotates about a central axis of the base portion, and is thus switched between the first state and the second state.

14. The liquid ejecting unit according to claim 13, wherein in a third state between the first state and the second state, the attachment portion approaches the second state by the biasing of the elastic body.

15. The liquid ejecting unit according to claim 13, wherein the coupling member is located between the elastic body and the support portion, the coupling portion includes a coupling surface that faces away from the coupling member, and the elastic body biases the attachment portion or the coupling portion in a biasing direction facing away from the support portion with respect to the coupling surface in the second state in which the support portion is in contact with the coupling surface of the coupling portion.

16. A liquid ejecting apparatus comprising the liquid ejecting unit according to claim 13.

17. A liquid ejecting unit comprising:

a liquid ejecting head configured to eject a liquid; and a coupling member being coupled to the liquid ejecting head, wherein the liquid ejecting head has a coupling portion, the liquid ejecting unit further comprises:

an attachment portion provided in the coupling member; and an elastic body that elastically biases the attachment portion or the coupling portion, in a state in which the attachment portion is in contact with the coupling portion, the elastic body biases the attachment portion or the coupling portion, so that the coupling member is coupled to the liquid ejecting head, and the coupling member is coupled to the liquid ejecting head by a restoring force of the elastic body, which is generated by shortening the elastic body to be shorter than a natural length, wherein a portion of the attachment portion is between the liquid ejecting head and the coupling member.

18. The liquid ejecting unit according to claim 17, wherein the attachment portion has a base portion provided in the coupling member, and a support portion that is provided in the base portion and that is in contact with the coupling portion, the coupling member is located between the elastic body and the support portion, the coupling portion includes a coupling surface that faces away from the coupling member, and the elastic body biases the attachment portion or the coupling portion in a biasing direction facing away from the support portion with respect to the coupling surface in a state in which the support portion is in contact with the coupling surface of the coupling portion.

19. A liquid ejecting apparatus comprising the liquid ejecting unit according to claim 17.

* * * * *